US009593839B2

(12) United States Patent
Gallego Sanz et al.

(10) Patent No.: US 9,593,839 B2
(45) Date of Patent: Mar. 14, 2017

(54) LED LAMP FOR PUBLIC LIGHTING

(71) Applicant: INELCOM INGENIERIA ELECTRONICA COMERCIAL, S.A., Pozuelo de Alarcon, Madrid (ES)

(72) Inventors: Daniel Gallego Sanz, Madrid (ES); Enrique Ferris Masia, Madrid (ES)

(73) Assignee: INELCOM INGENIERIA ELECTRONICA COMERCIAL, S.A., Madrid (ES)

( * ) Notice: Subject to any disclaimer, the term of this patent is extended or adjusted under 35 U.S.C. 154(b) by 269 days.

(21) Appl. No.: 14/391,368

(22) PCT Filed: Mar. 15, 2013

(86) PCT No.: PCT/ES2013/070176

§ 371 (c)(1),
(2) Date: Aug. 10, 2015

(87) PCT Pub. No.: WO2013/153246

PCT Pub. Date: Oct. 17, 2013

(65) Prior Publication Data

US 2015/0338083 A1 Nov. 26, 2015

(30) Foreign Application Priority Data

Apr. 12, 2012 (ES) ..... 201230546

(51) Int. Cl.
*F21V 29/71* (2015.01)
*F21V 29/77* (2015.01)
(Continued)

(52) U.S. Cl.
CPC ..... *F21V 29/71* (2015.01); *F21K 9/23* (2016.08); *F21S 8/085* (2013.01); *F21V 23/02* (2013.01);
(Continued)

(58) Field of Classification Search
CPC ..... F21V 29/71; F21V 29/70; F21V 29/77; F21V 23/02; F21V 29/74; F21V 19/0055;
(Continued)

(56) References Cited

U.S. PATENT DOCUMENTS 7,434,964 B1 * 10/2008 Zheng ..... F21V 29/006 362/218
7,654,699 B2 * 2/2010 Chang ..... F21V 29/02 362/294
(Continued)

FOREIGN PATENT DOCUMENTS

CN 202091825 U 12/2011
CN 202182345 U 4/2012
(Continued)

OTHER PUBLICATIONS

International Search Report; PCT/ES2013/070176; Aug. 13, 2013.

*Primary Examiner* — Bao Q Truong
(74) *Attorney, Agent, or Firm* — Studebaker & Brackett PC

(57) ABSTRACT

The lamp is provided for the purpose of replacing the conventional lamps in public lighting luminaires, said lamp comprising a succession of dissipating modules (3) which are fixed on a base (1) and are configured to fix, on the periphery thereof, at least one card (9) carrying a plurality of LEDs (10). The lamp is characterized in that the dissipating modules (3) are configured to assemble the contiguous modules and to simultaneously fix the card of LEDs; the different cooling modules (3) being separated from one another in order to allow the flow of air therebetween. The cards (9) of LEDs (10) have an elongated configuration. The dissipating modules (3) have a configuration formed by sectors separated from one another in order to provide a very wide contact surface which facilitates the heat dissipation.

11 Claims, 7 Drawing Sheets

(51) Int. Cl.

| | |
|---|---|
| ***F21V 23/02*** | (2006.01) |
| ***F21S 8/08*** | (2006.01) |
| ***F21V 29/70*** | (2015.01) |
| *F21W 131/103* | (2006.01) |
| *F21V 29/74* | (2015.01) |
| *F21Y 101/00* | (2016.01) |

(52) U.S. Cl.
CPC ..... *F21V 29/70* (2015.01); *F21V 29/77* (2015.01); *F21V 29/74* (2015.01); *F21W 2131/103* (2013.01); *F21Y 2101/00* (2013.01)

(58) Field of Classification Search
CPC ..... F21V 29/00; F21V 29/004; F21V 29/002; F21V 29/2212; F21V 29/75; F21V 29/76; F21V 29/763; F21V 29/767; F21V 29/777; F21V 19/00; F21V 19/001; F21V 19/003; F21K 9/23; F21S 8/085; F21W 2131/103; F21Y 2101/00; F21Y 2115/10
See application file for complete search history.

(56) References Cited

U.S. PATENT DOCUMENTS

| | | | | |
|---|---|---|---|---|
| 7,682,050 | B2 * | 3/2010 | Xiang | F21K 9/00 362/249.01 |
| 7,810,968 | B1 * | 10/2010 | Walker | F21S 8/08 362/218 |
| 9,030,120 | B2 * | 5/2015 | Pickard | F21V 29/767 315/291 |
| 9,212,791 | B2 * | 12/2015 | Kim | F21V 19/045 |
| 2009/0103294 | A1 * | 4/2009 | Zhang | F21V 29/004 362/234 |
| 2011/0273879 | A1 | 11/2011 | Hochstein | |
| 2013/0163240 | A1 * | 6/2013 | Chen | F21V 29/006 362/235 |

FOREIGN PATENT DOCUMENTS

| | | | |
|---|---|---|---|
| KR | 20090075471 | A | 7/2009 |
| WO | 2010/087877 | A1 | 8/2010 |

* cited by examiner

LED LAMP FOR PUBLIC LIGHTING

SUBJECT OF THE INVENTION

The invention pertains to a light-emitting diode (LED) light whose purpose is to replace the conventional lights in street lighting luminaries.

BACKGROUND

It is known that the technology for generating light by means of light emitting diodes (LED, Light Emitting Diode) provides for a very significant savings of energy compared to the other existing lighting technologies due to the fact that LED devices generate light from electrical energy with a higher yield in terms of lumens per watt and with higher quality in terms of chromic reproduction. At the same time, they have a longer service life than lights of the state of the art.

Due to the above-mentioned advantages, a great deal of development work has been done to improve various lighting applications using LED devices.

One of the possible applications is to use them in street lighting luminaries: Public areas in cities, public streets, parks, parking areas, etc.

The conventional way to undertake a street lighting project using LED technology is by installing new luminaries that are specifically designed for this technology, thereby replacing the conventional luminaries that existed previously. The reason why replacement is required is due to the specific thermal and optical requirements of the sources of LED light. The fact that it is necessary to replace the entire luminaries means that there is a very high cost that in many cases is not offset by the energy savings provided by the LED technology.

Numerous efforts have been made to solve this problem by adopting luminaries from technologies other than LED. The idea behind all these efforts was to develop a light built with LED technology that would make it possible to use it in an existing luminary by replacing the conventional light. These lights were therefore called LED replacement lights.

The problem of developing LED replacement lights for home lighting has been solved technically, and adequate commercial products exist.

For the field of street lighting, however, even though commercial LED replacement lights exist, they suffer from a number of deficiencies or drawbacks that limit many uses. The main issues standing in the way of developing a replacement LED light for street lighting are the following:

Conventional street lighting lights offer very high luminous flux values. Achieving equivalent values with LED devices requires an electric power that is much greater than that of home-use LED lights but is still smaller than that of conventional street lighting lights. Despite the high yield of LED technology, combined with the fact that such lights cannot operate at temperatures above 80° C. or 90° C. without losing yield and service life, and due also to the limitations that conventional lights have with respect to the evacuation of the heat generated inside them, it has not been possible to develop LED replacement lights for street lighting that are acceptably efficient and reliable.

Conventional lights for street lighting have light reflectors that are intended for lights that radiate omni-directionally. By their nature, LED devices radiate in a directional manner. This feature is advantageous for building specific LED luminaries since it avoids the use of light reflectors, but it is a drawback when it comes to building a replacement LED light.

In addition to the actual radiant LED device, LED technology requires the use of a power converter that adapts the supply voltage, usually alternating current, to the power required by LED semiconductor devices which, as we know, is direct current. Conventional luminaries do not require this kind of power converter, which has to be installed in the luminary or in the light itself; this latter option is the one that is most advantageous with regard to simplicity of installation, but it is the option that requires the power converter to operate under conditions of elevated temperature, making it difficult to do so reliably.

There are inventions that claim to solve the above-mentioned problems, but they do not do so satisfactorily or are not applicable to use in street lighting.

In this connection International Patent application WO2011/135151 can be cited, which describes a replacement light whose main drawback is the lack of dissipation devices that are sufficient to evacuate the heat to the outside. The dissipation devices that it presents are quite ineffective when they are confined in biconical housings with a minimal opening to the outside. Another drawback of these devices is the fact that the light that the LED devices emit is not radiated directly to the outside of the light, but rather cause it to be reflected at several conical metal reflectors that are likely to undergo oxidation and therefore experience impairment of their optical properties. Moreover, the above-described light does not have a built-in power adapter, and this makes it necessary to provide an external power adapter.

It is also possible to cite US patent application US2009/0267509, which describes a replacement light in which the LED radiant elements are confined inside a glass enclosure; this hampers the dissipation of the heat that is generated by the LED devices. The light is radiated in a single direction, which also makes this device unsuitable as a replacement light for street lighting.

US patent application US2010/0134046 can also be cited. This application describes an approach for adapting a conventional street-lighting light to LED illumination technology, but it cannot be regarded as a replacement light because it requires a great deal of manipulation in the luminary: it is not connected to the existing socket and requires additional mechanical anchoring devices.

US patent application US2011/0134239 describes a replacement light that radiates in just one direction, and therefore it cannot be used in luminaries that require omni-directional lights. The dissipation element is not modular, but rather is made up of a single block that is arranged on a panel of LED devices, meaning that the useful surface area of the dissipation device is reduced. Moreover, the effectiveness of the dissipation device is greatly compromised by the location of the device: between the LED panel and the power supply, both of which block the movement of air by the dissipation device.

The document that comes closest to the invention is CN 202203704 U (QINZHENG HUANG), which describes an LED light for lighting that includes a base that is equipped with a fitting for attachment to the socket of a luminary and for electrical connection, and it also comprises an AC-DC power converter that is required for LEDs. The LED light described in this document also includes a number of heat dissipation modules that are mounted on the base in order to facilitate the cooling of the light. However, these modules are not configured to house along their periphery carrying cards for a number of LEDs, which makes it easier to incorporate them.

The document CN 202091825 U (DUJIANGYAN HUAGANG ELECTRONIC TECHNOLOGY CO LTD.), which was published on Dec. 28, 2011, describes the integration of a number of heat dissipation modules that are mounted on the base and are configured to attach around their periphery at least one card that carries a number of LEDs; in addition, these dissipation modules also comprise a number of cooling fins (FIG. 1), but this document does not call for the LED card to be mounted on contiguous dissipation modules, rather taking advantage of the actual mounts of these dissipation modules.

The invention provides a new configuration of the dissipation modules that makes it possible to mount the LED cards at the same time as when the dissipation modules are mounted; this simplifies fabrication.

SPECIFICATION

In order to achieve the above-mentioned goals and remedy the above-mentioned drawbacks, the invention consists of a street-lighting light that is provided for the purpose of replacing the conventional lights in street-lighting luminaries in such a way that, like the lights provided for in the state of the art, it comprises a base that includes a fitting for attachment to a socket of a luminary, thereby also constituting the socket that is the means for connecting to the power grid. Moreover, the invention comprises a number of heat-dissipating modules that can be assembled together, forming a series of dissipating modules attached to the base. The dissipating modules comprise a number of cooling fins, which are grouped together forming n sectors a certain distance apart which define n sectors of separation in order to allow air to circulate among the cooling fin sectors. The dissipating modules also comprise a central body from which radial extensions protrude and to which the cooling fins are attached, thereby forming the cooling fin sectors, and the free ends of the radial extensions that are equipped with means for assembling the various dissipating modules and with means for attaching to an LED card in order to attach an LED card to each cooling fin sector; where the fins are defined by lateral extensions that are provided on one or both lateral faces of the radial extensions; the lateral ends of these lateral extensions of each radial contiguous extension are separated to form the cooling fin sectors and the sectors of separation. In addition, the interior of the base comprises a converter for converting AC to DC, which is the current required by the LEDs. Said converter is connected to a circuit for controlling the application of the supply voltage to the LEDs, which is also arranged inside the base.

The chief novelty of the invention lies in the fact that it calls for the free ends of the radial extensions to be terminated by a vertical surface that extends above and below the upper and lower parts of said radial extensions. One of the ends of the vertical surface is equipped with an interior ladder inside of which the opposite end of the vertical surface of a continuous dissipating module is attached. In addition, said ends of the vertical surface are equipped with some openings, corresponding to the openings that the LED card also has, such that it is through these openings that the assembly of the contiguous dissipating modules is accomplished and at the same time the attachment of the LED card on the vertical surface formed by the grouping of cooling modules is accomplished, so that the means of assembling the contiguous dissipating modules are provided, as are the means of attaching an LED card on the vertical surface. In this case, the LED card has a lengthened configuration of a width that is equal to or less than those of the vertical surfaces. Since the vertical surface extends above the upper and lower parts of the radial extensions by interconnecting the different dissipating modules, the modules are separated from one another in order to allow air to circulate among them, thus ensuring better cooling. This configuration dictates that a single LED card be mounted on contiguous dissipating modules, thus also taking advantage of the openings arranged in the ladder in order to secure the card; this feature is not described in any of the documents of the state of the art.

Therefore, the LED-carrying card is secured in the periphery of the series of interconnected dissipating modules. In the preferred embodiment the sectors are arranged in such a way as to form an order-3 radial symmetry, but clearly any other configuration with n sectors of separation can be adopted. In the preferred embodiment of the invention, these LED cards are provided as radial extensions, and the sectors of fins hold the dissipating modules.

Each of the radial extensions of a dissipating module has in turn lateral extensions on one or both lateral faces, extending toward the adjacent radial extensions of the same module, without the lateral extensions of two adjacent radial extensions of the same module coming into contact with one another since they are separated by the above-mentioned sector of separation.

It is provided that the central body be made up of an annular body through which air is permitted to circulate.

Moreover, in the preferred embodiment of the invention, the lateral extensions of the cooling fins are made up of lengthened bodies, one of whose ends is secured transversely to a lateral side or face of the radial extensions. The lengthened body that defines the lateral extensions of the cooling fins also comprises some vertical cooling extensions that extend above and below said lengthened body. On their upper and lower faces, the radial extensions are also equipped with a number of vertical cooling extensions, which are equivalent to those arranged in the lengthened body that is comprised by the lateral extensions of the cooling fins, thus creating an assembly with a high degree of cooling.

The invention calls for the lengthened bodies of the lateral extensions of the cooling fins to have a configuration that is curved and where the extensions are parallel to one another. In addition, the length of the lengthened bodies of each sector increases from the inside outward, forming circular cooling-fin sectors.

Moreover, in order to facilitate cooling, it is provided that the radial extensions comprise a certain width in which a central radial groove is located through which air is permitted to circulate.

In order to protect the LEDs, the invention comprises a transparent cover that consists of a semi-tubular longitudinal body which, on its long sides, is equipped with grippers for attaching to the vertical surface that terminates the free ends of the radial extensions, in such a way that the transparent cover is arranged to slide on the rear faces of said vertical surfaces that terminate the free ends of the extensions, so that the transparent cover covers and protects the LED diodes mounted in the card, while at the same time permitting said diodes to emit their light to the outside of the transparent cover. Optionally, said cover can be translucent if greater dispersion of the light radiation is desired.

In addition, the invention calls for an end dissipating module that faces the base to have an outer face that is configured to secure an end LED card, in such a way that at said end light is also emitted. In the embodiment in which the sectors of cooling fins form circular sectors, said end card has an annular configuration in which a number of LEDs that is equal to the number of radial fin sectors are secured.

In one embodiment of the invention, the LED card or cards comprise a temperature sensor that is connected to the control circuit, which in turn is configured to regulate the power to the LEDs as a function of the temperature detected by the sensor, so as to avoid the possibility that the LEDs will overheat, as could happen, for example, if the light is turned on during the day when the luminary is very hot due to the action of the sun, or to ensure that overheating is avoided when the dissipation device of the light becomes dirty and heat is no longer dissipated adequately.

Another feature of the invention consists of the fact that the light comprises a communications module, which can also be housed in the base. Said communications device can be wireless, or it can transmit through the actual power lines, such that in any of these cases it is possible to effect remote control of the light to adjust its intensity, turn it on or off, or monitor its condition.

It should also be mentioned that the control circuit can be connected to a control unit to ensure the manual regulation of the luminous intensity of the LEDs, which makes it possible for the same model of light to be used to replace conventional lights of different powers simply by adjusting the level of current of the LED devices.

The above-describe configuration provides a very broad surface area for contact with the air; this improves the evacuation of the heat produced by the LEDs to the air that surrounds the light.

Below, to make this patent specification more understandable, and as an integral part thereof, a series of figures is attached in which, by way of illustration and without being limiting, the subject of the invention is depicted.

DESCRIPTION OF THE PREFERRED IMPLEMENTATION

Figure 1:
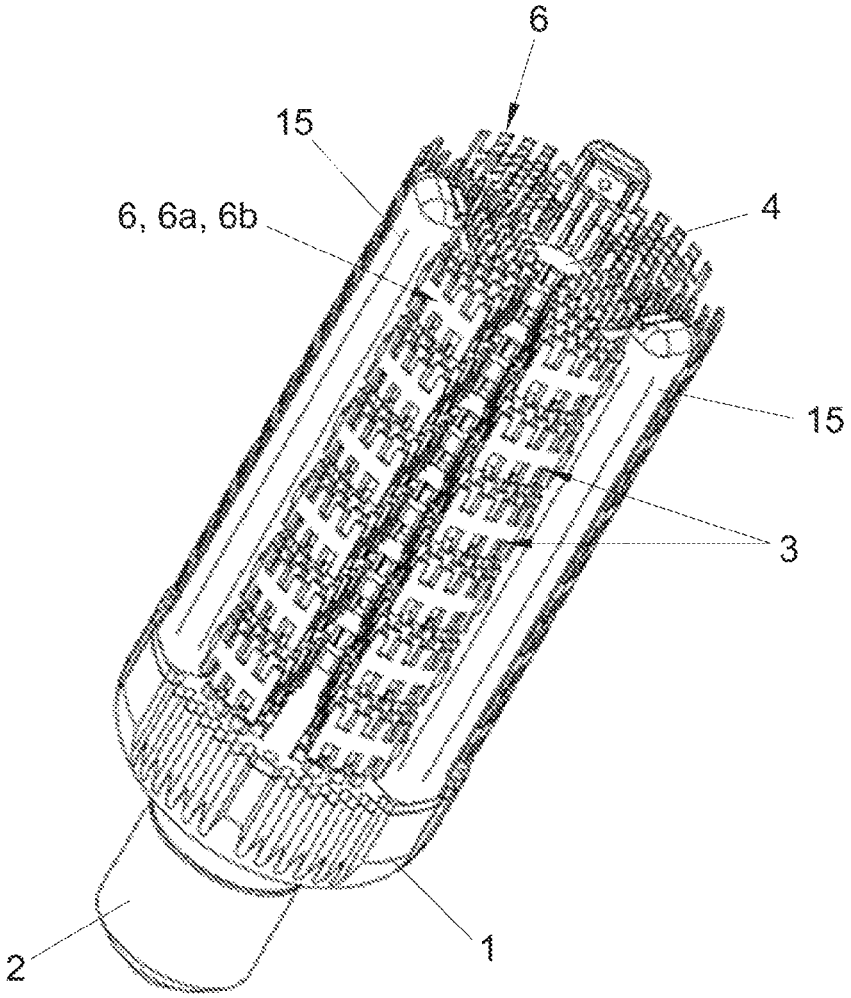
FIG. 1—shows a perspective view of a possible example embodiment of the light of the invention.
Figure 2:
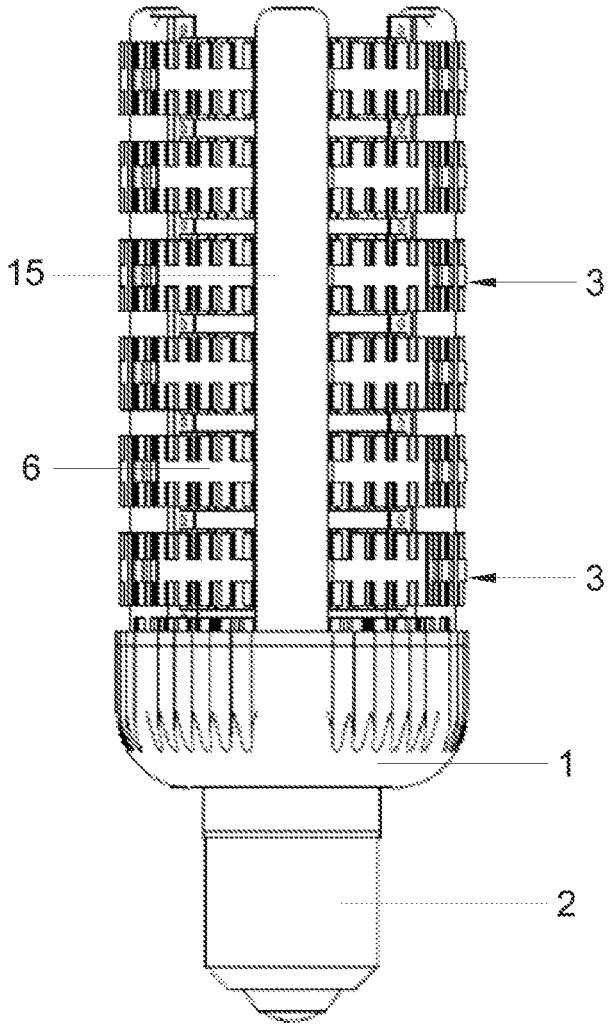
FIG. 2—shows a top view of the light of the previous figure.
Figure 3:
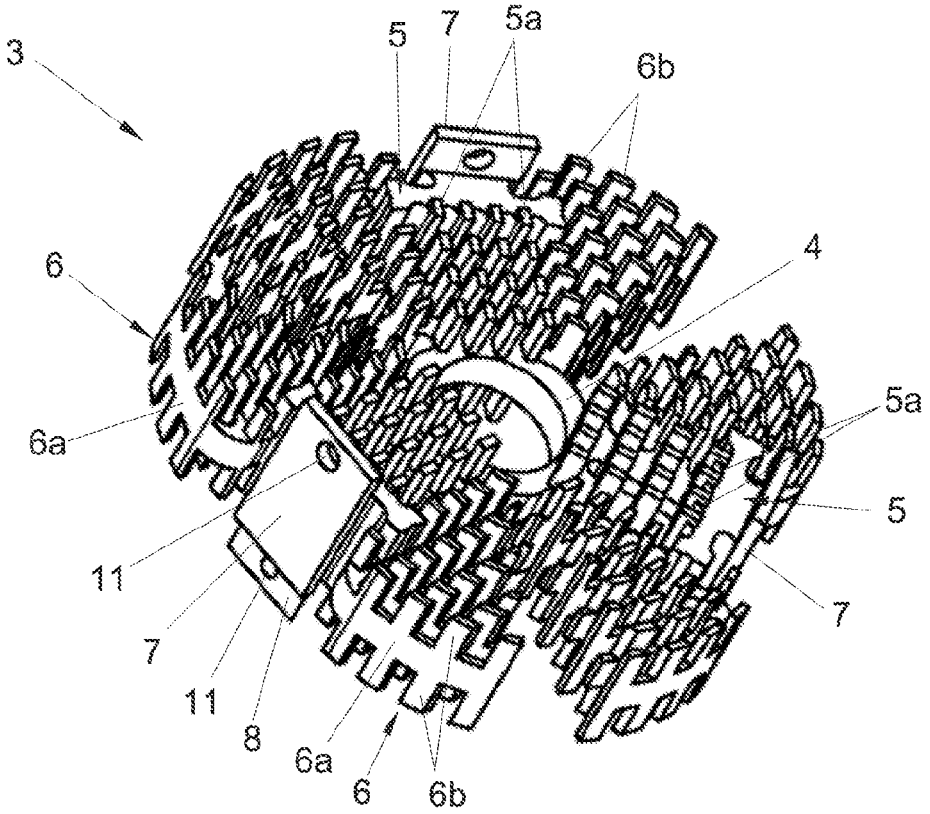
FIG. 3—shows a perspective view of a heat-dissipating module used to make the light depicted in the previous figures.
Figure 4:
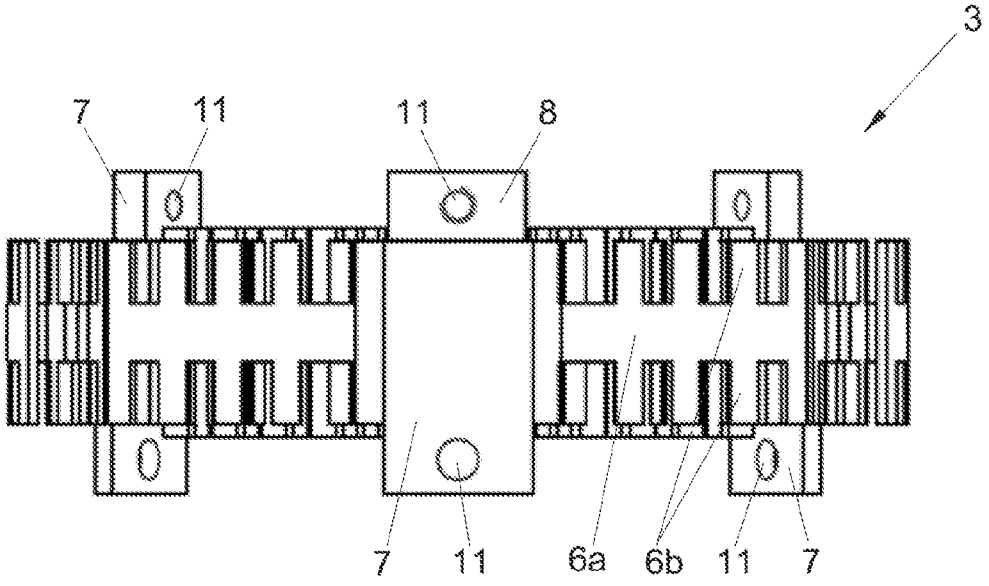
FIG. 4—shows a top view of the dissipating module of the previous figure.
Figure 5:
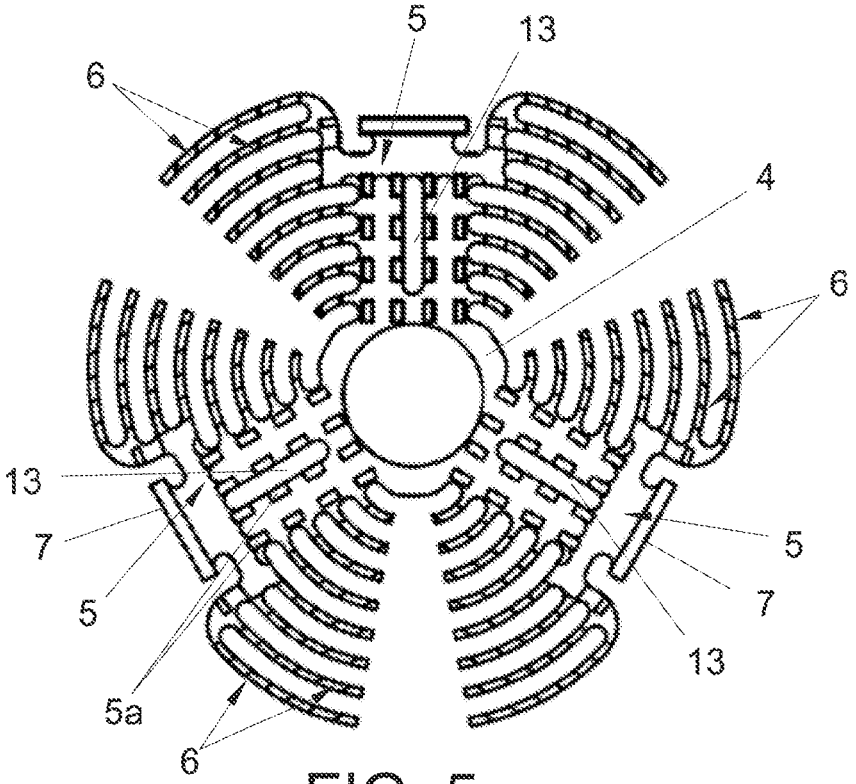
FIG. 5—shows a plan view of the dissipating module of FIG. 3.
Figure 6:
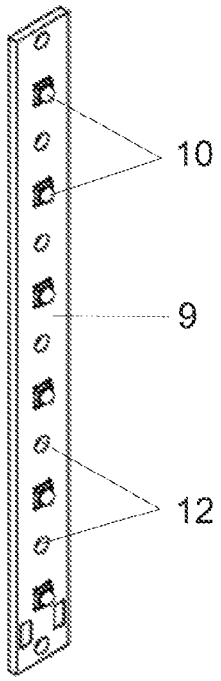
FIG. 6—shows a perspective view of an embodiment of the LED card.
Figure 7:
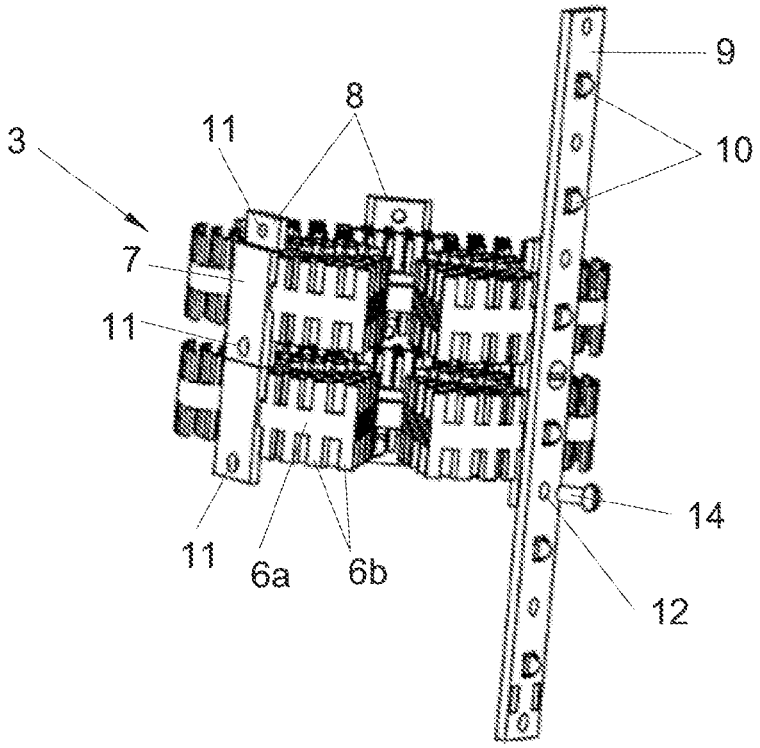
FIG. 7—shows a perspective view of the connection of two heat-dissipating modules and the arrangement of the LED cards thereon.
Figure 8:
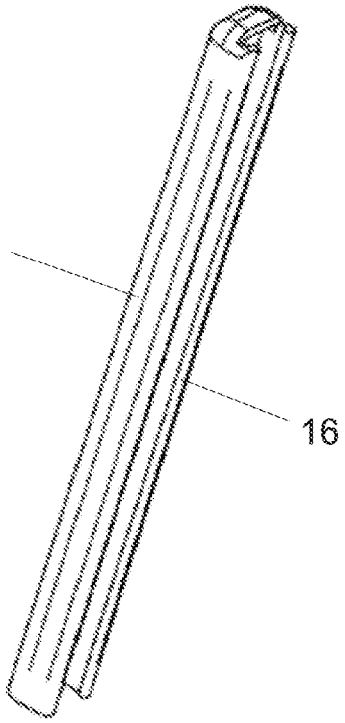
FIG. 8—shows a perspective view of the transparent cover that protects the LED card.
Figure 9:
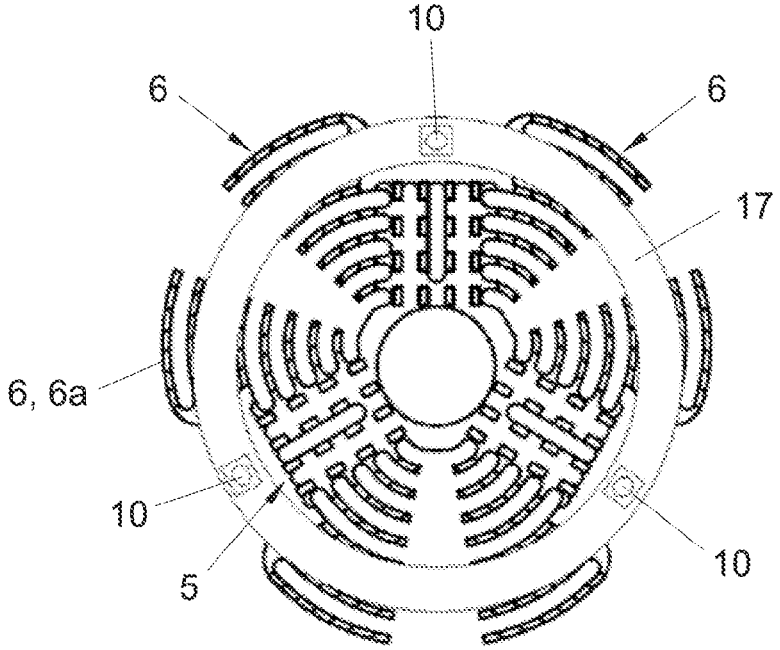
FIG. 9—shows a plan view of the end dissipating module on whose upper end face an LED card is located for emitting light from this end face.
Figure 10:
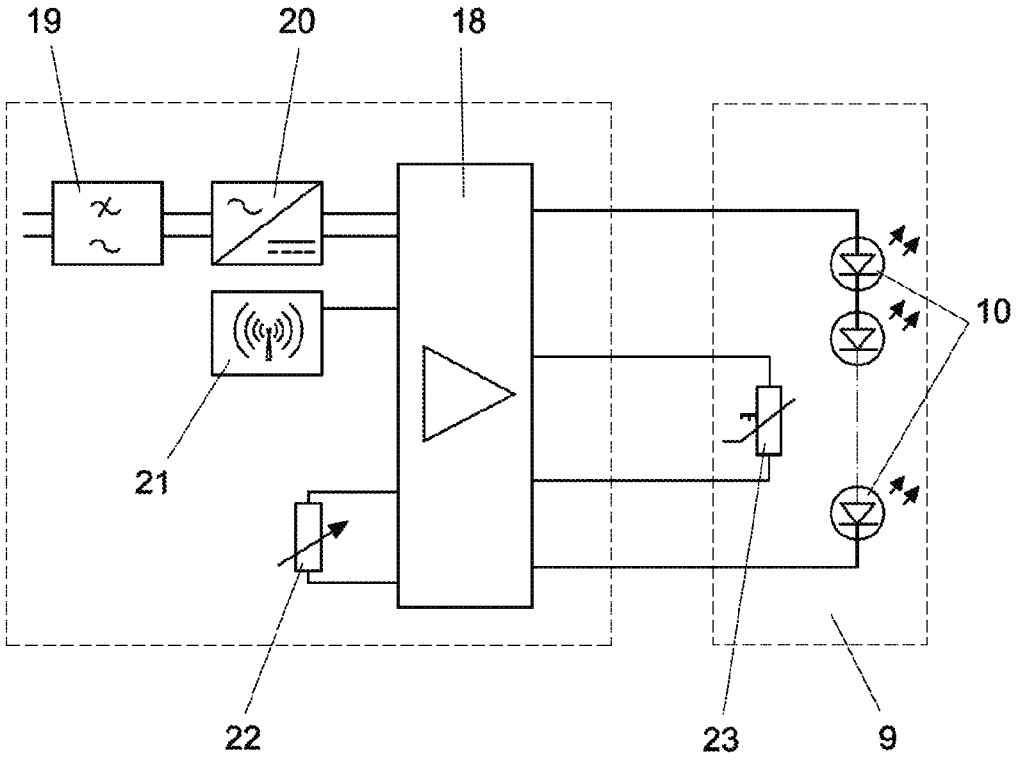
FIG. 10—shows a functional wiring diagram of the light.

Below a description is given of the invention based on the above-mentioned figures.

The light of the invention consists of a base 1 that is equipped with a conventional fitting 2 which, in the preferred embodiment is of type E40, for mechanically attaching to the socket of the luminary and at the same time for making the electrical connection between the light and the power grid.

Above the base 1 it comprises a number of interconnectable dissipating modules 3, forming a series of dissipating modules 3 that are connected together and attached to base 1.

The dissipating modules 3 are made of aluminum to facilitate the dissipation of heat.

Each of the dissipating modules comprises a central body 4 that is tubular in shape and from which some radial extensions 5 emerge in which a number of cooling fins 6 are mounted; said cooling fins are made up of lateral extensions that are provided on both lateral faces of the radial extensions 5. More specifically, the lateral extensions that constitute the cooling fins 6 comprise a lengthened body 6*a*, one of whose ends is secured transversely in a lateral face of the radial extensions 5. The lengthened body 6*a* is equipped with vertical extensions 6*b* that extend above and below the lengthened body 6*a*. Said lengthened body has a curved shape and a length that increases from the inside lengthened section toward the outside, forming circular sectors. In the example embodiment three separate circular sectors with an angle of 120° between them, separated by sectors of separation, are depicted. The preferred embodiment of the invention calls for the dissipating modules 3 to have a radial asymmetry of order n, where in the example embodiment n=3, and in which the cooling sectors occupy 100° and 20° and correspond to the sectors of separation. Consequently, instead of three sectors, it is possible to have four, five, or six, such that the radial extensions 5 are separated, respectively, by 90°, 72°, or 60°.

In addition, the radial extensions 5 have a certain width in whose upper and lower faces there are also a number of vertical cooling extensions 5*a*.

To provide the connection among the different dissipating modules 3, the invention calls for the free ends of the radial extensions 5 to be terminated by a vertical surface 7 that extends above and below the radial extensions 5, such that in one of its ends it comprises an interior ladder 8 for coupling the opposite end of the vertical surface 7 of a contiguous dissipating module, and such that the different vertical surfaces 7 of the different dissipating modules 3 are aligned longitudinally; this ensures that likewise the rest of the above-described elements that make up each of the dissipating modules 3 are aligned longitudinally. In the above-described configuration, the vertical extensions 6*b* and 5*a* of the different cooling modules 3 are separated from each other in order to allow air to circulate among the different cooling modules 3.

The alignment of the vertical surfaces 7 makes it possible to mount on each of them a card 9 that carries a number of LEDs 10. To ensure this mounting and to interconnect the different dissipating modules 3, the invention calls for the vertical surfaces 7 to be equipped at their ends with some openings 11, corresponding to which the cards 9 have some openings 12, such that the connecting point among the dissipating modules 3 is also the point for anchoring with the cards 9 of LEDs 10; this connection is provided by means of a screw 14 that is inserted from the outside, passing through the card 9 via one its openings 12 and also passing through the opening 11 of the vertical surface 7 that ultimately twists onto the opening 11 that is provided on the ladder 8 of the contiguous vertical surface 7, providing mechanical clamping for the joint and keeping pressure on the connection between the card 9 of LEDs 10 on the dissipator; this makes it possible to ensure adequate thermal contact between the card 9 of LEDs 10 and the dissipating modules 3. The attachment of the group of the different dissipating modules 3 to each other at the base is accomplished by means of the same system, that is, on the base 1 there are the vertical surfaces 7, not shown, to ensure this attachment to the vertical surfaces 7 of the module that is attached to the base, but clearly this can also be done in any other way. The radial extensions 5 are equipped with a groove 13 that extends along the different dissipating modules 3, where this groove is radial with respect to the axis of the light, thus facilitating cooling.

The above-described configuration provides a very broad surface area for contact with the air; this facilitates the evacuation of the heat generated by the LEDs 10 out to the air that surrounds the light.

The cards 9 of LEDs 10 are protected by a transparent cover 15 that insulates them from the weather; to do so, the cover is longitudinal and semi-tubular in shape and on its long sides includes some grippers 16 for attachment to the vertical surface 7. The transparent cover 15 is attached by sliding onto the vertical surfaces 7 once the dissipating assembly is assembled by means of screws 14 as described above.

For cases where it is required that the light emit luminous flux power in the direction of its axis, an end card 17 that carries LEDs 10 is provided that is installed on the dissipating module 3 that is furthest from the base 1 and in the example embodiment has an annular configuration that includes three LEDs that are arranged corresponding to each of the radial extensions 5, but clearly any other number of LEDs can be incorporated.

In its interior the base 1 houses a control circuit 18 which is connected to the power grid via a filter 19 and an AC to DC converter 20, such that the control circuit 18 is configured to supply direct current to the LEDs 10.

The filter 19 and the converter 20 are also located inside the base 1; this makes it unnecessary to use any other external conversion element.

The card 9 of LEDs 10 is equipped with a temperature sensor 23 that performs the function of thermal protection, such that the control circuit 18 is configured to regulate the intensity of the current supplied to the LEDs 10 as a function of the temperature that they reach. In this way overheating, which can have destructive effects on the light, as mentioned in the descriptive part of the invention, is avoided.

In addition, the control circuit 18 is connected to a control device 22 to provide for manual regulation of the luminous intensity of the LEDs. The control device 22 can be, for example, a variable resistor or potentiometer.

Moreover, the control circuit 18 is connected to a communications module 21 which in the example embodiment is a wireless radio-frequency communications module, such that it is possible to control the functionality of the light from a remote device, making it possible to control turning it on and off, regulate luminosity, or monitor its state. The communications module 21 can also be of the type that transmits through the actual power lines.

The control module 21 is also located in the interior of the base 1, and the control device 22 for regulating luminosity can be arranged on the base 1 itself, in a user-accessible location.

The invention claimed is:

1. An LED light for street lighting, that is provided for replacing conventional lights in street-lighting luminaries, comprises:

a base (1) that is equipped with a fitting (2) for attachment to a socket of a luminary and for power connection;

a number of heat-dissipating modules (3) that can be interconnected, forming a series of dissipating modules (3) that are attached to the base (1) and that comprise:

a number of cooling fins (6) that are grouped together forming n sectors located a certain distance apart that define n sectors of separation in order to allow air to circulate among cooling fin sectors;

a central body (4) from which some radial extensions (5) extend, to which the cooling fins (6) are attached, forming the cooling-fin sectors, whereby the free ends of the radial extensions (5) are equipped with means for assembling the different dissipating modules (3) and with means for securing a card (9) of LEDs (10) in order to secure a card (9) of LEDs for each cooling-fin sector;

where the cooling fins (6) are defined by lateral extensions that are provided on one or both lateral faces of the radial extensions (5), where the lateral ends of said lateral extensions of each contiguous radial extension are separated to form the cooling-fin sectors and the sectors of separation;

a converter for converting alternating current to direct current (20), which is required by the LEDs (10), where said converter is arranged inside of the base and is connected to a control circuit (18) for application of the supply voltage to the LEDs (10), where said converter is also located inside the base (1), wherein:

the free ends of the radial extensions (5) are terminated by a vertical surface (7) that extends above and below said radial extensions (5) and in one of whose ends there is an interior ladder (8) for attaching the other end of the vertical surface (7) of a contiguous dissipating module (3); said ends of the vertical surface (7) comprise some openings (11) corresponding to those [sic] the card (9) of LEDs (10) also comprises openings (12) for creating the means for assembling contiguous dissipating modules and at the same time the means of attaching a card (9) of LEDs (10) on the vertical surface (7) that is formed by the grouping of cooling modules (3); the different cooling modules (3) are separated from one another in order to allow air to circulate among them; and where the cards (9) of LEDs (10) have a lengthened configuration.

2. An LED light for street lighting, in accordance with claim 1, characterized by the fact that the cooling-fin sectors are arranged in such a way as to form radial symmetry.

3. An LED light for street lighting, in accordance with claim 1, characterized by the fact that the lateral extensions of the cooling fins (6) comprise an lengthened body (6*a*), one of whose ends is secured transversely in a lateral face of the radial extensions (5); said lengthened body (6*a*) comprises vertical cooling extensions (6*b*) that extend above and below said lengthened body (6*a*), and on their upper and lower faces the radial extensions (5) comprise a number of vertical cooling extensions (5*a*).

4. An LED light for street lighting, in accordance with claim 3, characterized by the fact that the lengthened bodies (6*a*) of the lateral extensions of the cooling fins (6) are curved and are parallel to one another, where the length of the lengthened body (6*a*) increases from the inside outward, forming circular sectors of cooling fins (6).

5. An LED light for street lighting, in accordance with claim 1, characterized by the fact that the central body (4) is an annular body in order to facilitate the circulation of air.

6. An LED light for street lighting, in accordance with claim 1, characterized by the fact that the radial extensions (5) comprise a certain width within which a central radial groove (13) is located for circulation of air.

7. An LED light for street lighting, in accordance with claim 1, characterized by the fact that it comprises a transparent cover (15) for protecting card (9) of LEDs (10), where said cover is made up of a longitudinal semi-tubular body that is equipped on its long sides with grippers (16) for attaching to the vertical surface (7) that terminates the free ends of the radial extensions (5) in order to protect the card (9) of LEDs (10).

8. An LED light for street lighting, in accordance with claim 1, characterized by the fact that the end dissipating module (3), which is opposite the base (1), has an end face that is configured to secure an end card (17) of LEDs (10).

9. An LED light for street lighting, in accordance with claim 1, characterized by the fact that the card (9) of LEDs (10) comprises a temperature sensor (23) that is connected to the control circuit (18) which, in turn, is configured to adjust the power supply of the LEDs (10) as a function of the temperature detected by the sensor (23), thereby keeping them from overheating.

10. An LED light for street lighting, in accordance with claim 1, characterized by the fact that it comprises a communications module (21) that is either a wireless communications module or a module for communication over the power grid, where said communications module is connected to the control circuit (18) in order to control the functionality of the light remotely.

11. An LED light for street lighting, in accordance with claim 1, characterized by the fact that the control circuit (18) is connected to a control unit (22) for manually regulating the luminous intensity of the LEDs (10).

* * * * *